US005730529A

United States Patent [19]

Fritz et al.

[11] Patent Number: 5,730,529

[45] Date of Patent: Mar. 24, 1998

[54] COMBINATION BEACH MAT AND CARRYING DEVICE

[76] Inventors: Kyle D. Fritz; Margaret E. Fritz, both of 1979 Grace Ave., Suite #5A, Hollywood, Calif. 90068

[21] Appl. No.: 687,214

[22] Filed: Jul. 25, 1996

[51] Int. Cl.[6] ..... B65D 30/10

[52] U.S. Cl. ..... 383/4; 383/38; 5/417; 5/419; 224/153

[58] Field of Search ..... 383/4, 38, 39; 5/417, 419; 224/153, 557

[56] References Cited

U.S. PATENT DOCUMENTS

| | | | |
|---|---|---|---|
| 3,689,947 | 9/1972 | Wolf | 5/344 |
| 4,097,944 | 7/1978 | Yulish | 5/344 |
| 4,101,994 | 7/1978 | Hoyt | 5/344 |
| 4,195,378 | 4/1980 | Parker | 5/419 |
| 4,231,125 | 11/1980 | Tittl | 5/419 |
| 4,466,516 | 8/1984 | Sicoli | 190/2 |
| 4,546,507 | 10/1985 | Weinstein | 5/419 |
| 4,587,682 | 5/1986 | Schultz | 383/4 X |
| 4,604,765 | 8/1986 | Schultz | 383/4 X |
| 4,991,245 | 2/1991 | Franco | 5/419 |
| 5,072,467 | 12/1991 | Hunt | 5/417 |
| 5,110,219 | 5/1992 | Lopes | 383/4 |
| 5,346,308 | 9/1994 | Buhot et al. | 5/417 X |

FOREIGN PATENT DOCUMENTS

| | | | |
|---|---|---|---|
| 28323 | 8/1931 | Australia | 5/419 |
| 77288 | 8/1950 | Norway | 5/419 |

*Primary Examiner*—Jes F. Pascua
*Attorney, Agent, or Firm*—Schmeiser, Olsen & Watts

[57] ABSTRACT

A combination beach mat and carrying device. The mat has a pillow section and several storage sections closed by a closure having a flap to protect the closure from sand. Additionally, the mat has securing straps for binding up the mat for easy transportation, and a carrying strap for carrying the bound up contents. The carrying strap is located along the seam of the pillow and mat sections. The securing straps are extended beyond the bounds of the mat to be located out of the way.

4 Claims, 2 Drawing Sheets

COMBINATION BEACH MAT AND CARRYING DEVICE

BACKGROUND OF THE INVENTION

1. Field of the Invention

The present invention generally relates to beach gear and more particularly to a mat for sunbathing and the like that accommodates the user and that is conveniently portable.

2. Description of the Related Art

A common sight at resort beaches, lakes, swimming pools, and the like is a person or group struggling from an automobile to a selected site on the beach, laden with assorted beach paraphernalia. While food lockers, balls, frisbees, and the like may or may not be included, almost universally the burden will include assorted blankets and towels, pillows, various lotions and ointments, and various bags or suitcases containing articles of clothing. The image presented is sufficiently common to virtually constitute a caricature of itself: the person slipping and sliding through the sand while supporting a precarious pyramid of assorted materials to be spread out as the person's own oasis on the beach.

Equally common is the scene, either at the end of the day or at the onset of bad weather, of repacking and removing the same sundry goods back to the automobile. Indeed, the process of attempting to shake or remove water and sand from assorted blankets, towels, pillows, and clothing, and folding them all neatly for the trek home forms a comical scene mating perfectly with the morning's journey from car to beach.

Each of the following patents are related to the present invention and are incorporated herein by reference for the supporting teachings:

U.S. Pat. No. 5,072,467, is a beach towel that has envelopes attached thereto so as to create closeable envelopes on the towel and pockets behind the envelope. The envelopes and pockets can be used for storing needed items such as sunscreen lotion, clothing items, or entertainment items such as a book or radio. The envelopes and pockets can alternatively be used as a receptacle for sand in order to hold down the beach towel and form a pillow.

U.S. Pat. No. 5,110,219, is a combination beach mat/bag made of a sheet of terry cloth or other fabric having a pair of opposed side edges and a pair of opposed end edges, the sheet preferably being of rectangular shape. A flexible strap is attached to the sheet at the corners, and each strap has an anchor pod secured on a distal end thereof. The sheet has a handle at each of the end edges and zippers along each of the side edges. The sheet is adapted to be folded in half along a line between the side edges such that the side and end edges are superimposed and the side edges zipped up to form an open top tote bag which may be carried by the handles. The sheet is further adapted to be unzipped, unfolded and spread on a beach surface and the anchors buried below the beach surface to secure the sheet. The anchor pad is releasably secured to the strap by a snap fastener, and the snap fasteners on adjacent straps at the end edges may be further fastened to each other to form the handles. Each strap also includes a fastener for removably securing the anchor directly to the sheet. An inflatable head rest may be removably secured to the sheet near one end.

U.S. Pat. No. 4,991,245, is a portable lounge and pillow, the lounge portion being made of a sheet material such as plastic or fabric, and is convertible to and from a tote bag for carrying articles by folding portions of a sheet over and upon one another about transverse and longitudinal folds to form interior article-holding compartments. Carrying handles are positioned in registry with each other after folding of the sheet portions, and serve as a convenient hand-grip for carrying the articles. A cover sheet is detachably mounted on a sheet such as a fabric sheet for user comfort. A strap hanger enables the lounge or pillow set to be supportably suspended for air drying. Additional article-holding pockets are formed in the sheet for increased carrying capacity. A device for securing the lounge or pillow in a roll without having to deflate the pillow may be provided.

U.S. Pat. No. 4,546,507, is a beach kit that includes a beach towel, an inflatable pillow, a pillow cover in that the pillow is received, and stakes for staking the pillow cover and towel together to the sand. The cover is convertible into a carrying bag or case and includes reinforcing members located along two edges, and fasteners at the corners for connecting the ends together to form the bag. The stakes fit through aligned openings in the cover and towel to hold the two together.

U.S. Pat. No. 4,466,516, is a multi-purpose sun blanket and tote bag that is formed of a foldable blanket-like material in the form of a mat. This mat constitutes a substantially rectangular first area having a major axis and a minor axis in which the mat defines at least four substantially equally spaced fold lines disposed transversely to the major axis of the mat. There is also provided a second area of the mat which is integral to the first area thereof and is separated therefrom by one of said spaced fold lines of the first area. The second area of the mat defines a subrectangle of about the same area and shaped of each of the four subrectangles of the first area. Further fold lines are provided within the subrectangle of the second area to define three sub-subrectangles which, when folded, will create like and similar sub-subrectangular folds within the subrectangle of the first area.

U.S. Pat. No. 4,231,125, is a beach towel or the like for use with a pillow, and characterized by simplicity and economy of construction, and the use of elements substantially impervious to corrosion by salt and damage from sand. The beach towel comprises an elongate, substantially rectangular fabric piece defining opposing, laterally extending top and bottom end edges and opposing, longitudinally extending side edges. A pair of longitudinally spaced-apart and laterally extending attachment members are secured to the fabric piece proximate its top end for permitting the top end of the fabric piece to be folded over itself and releasably attached in such position to form a tube for enclosing a pillow. One of the attachment members comprises a patch having numerous rows of hoop-like projections, and the other of the pair of attachment members comprises a patch of loose, fibrous, non-woven material for releasable interlocking with the hook-like projections.

U.S. Pat. No. 4,195,378, is an oversize, heavy duty beach towel with sealable pockets at one end. The pockets are located so as not to interfere with the use of the towel for drying oneself off after swimming or for reclining. The pockets are designed to enclose various items that may be brought to the beach. One of the pockets is larger than the others, and is located at the middle of one end of the towel to facilitate its use as a pillow when filled with soft, bulky material. Waterproof zippers and linings protect the contents of the pockets from moisture. The towel unit includes a removable handle to be used for retaining the towel and its contents in a convenient package when the towel is rolled or folded.

U.S. Pat. No. 4,101,994, is a combination beach bag and blanket construction comprising a rectangular bag portion having a stiffening member on the bottom side and receptive of gear for holding same and to alternatively provide a pillow. A flexible planar portion is connected to the bag portion and foldable into a rectangular configuration similar to that of the bag portion. A flexible carrying handle is connected to the top side of the bag portion with one end extendable around the folded blanket for use with the other end to carry the construction as a beach bag.

U.S. Pat. No. 4,097,944, is a beach mat that has an integral pillow and pockets for beach wear or the like. An elongated fabric piece defines the body of the mat, and at one end is folded back upon itself to enclose a pillow in the central portions. In particular, the body of the mat is stitched to the pillow, and the flaps on either side of the pillow are also stitched to the fabric piece and appropriately cut and bound to define pockets for beach wear and the like. The opposite end of the mat carries tie straps, to enclose the appropriately folded mat in a neat package.

U.S. Pat. No. 3,689,947, is a towel that is combined with a pillow so that a person may recline on the towel placing his head comfortably on a pillow. The towel is formed at one end with a pocket in which the pillow is removably located, and the pillow is preferably inflatable so that it can be deflated to facilitate storage while at the same time it can be removed to facilitate washing of the towel.

These patents are incorporated by reference and reflect the state of the art of which the applicant is aware. They are tendered with a view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE PREFERRED EMBODIMENT

It is a feature of the invention to provide a combined towel, beach lounging and sleeping pad, and suitcase. In particular the towel has 1) an oversized, heavy-duty sheet of toweling material; 2) a continuous piece of toweling material attached to the sheet in a plurality of locations in a manner forming a large storage container substantially the size of a pillow at the center of one end of the toweling sheet for receiving and storing soft, bulky material and forming a plurality of additional individual storage containers on said toweling sheet, the additional containers being located toward the edges of the sheet to permit unimpeded use of the toweling sheet for reclining or for drying oneself after swimming; 3) closing means, attached to the towel, for sealing the storage containers; 4) securing means, attached to the ends of the storage containers to extend away from the towel, for securing the towel when in a rolled position for carrying the towel and its contents; and 5) carrying means, attached to a back side of the towel parallel to the securing means and located under the securing means when the towel is in a rolled out position, for placing over a shoulder of the user when the towel is in a rolled up position for transporting.

An additional feature of the invention is to provide a beach mat. The mat includes: 1) an elongated, generally rectangular fabric piece that when flat defines the extent of the mat; 2) pillow means attached to and at one longitudinal extremity of the fabric piece, the pillow being centered substantially on the longitudinal axis of the piece, the pillow having a width extending in both directions from the axis to predetermined distances short of the side extremities of the fabric piece; wherein the pillow means and the fabric piece together comprise an integral unit; 3) a plurality of rectangular fabric overlays, on each side of the pillow and extending from the end of the pillow to the associated side extremity of the fabric piece, each of the fabric overlays being attached to the fabric piece on three sides to define storage pockets; 4) strap means, attached to the storage pockets to lay out away from the mat, for securely holding the mat in a rolled position; 5) carrying means, attached on a bottom side of the mat and laying along an edge located between the pillow means and the mat when the mat is in an unrolled position, for carrying the mat when in a rolled position so that the carrying means is attached to opposite edges of the mat so as to straddle the strap means; and 6) closing means, attached between the mat and storage pockets, for sealing the pockets and pillow.

The invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is not intended to define the invention of the application, which is measured by the claims, nor is it intended to be limiting as to the scope of the invention in any way.

Other features of the present invention will become more clear from the following detailed description of the invention, taken in conjunction with the accompanying drawings and claims, or may be learned by the practice of the invention.

It should be noted that the drawings of the invention are not to scale. The drawings are merely schematic representations, not intended to portray specific parameters of the invention. The drawings are intended to depict only typical embodiments of the invention, and therefore should not be considered as limiting the scope of the invention. The invention will be described with additional specificity and detail through the use of the accompanying drawings.

DETAILED DESCRIPTION OF THE PREFERRED EMBODIMENT

Figure 2:
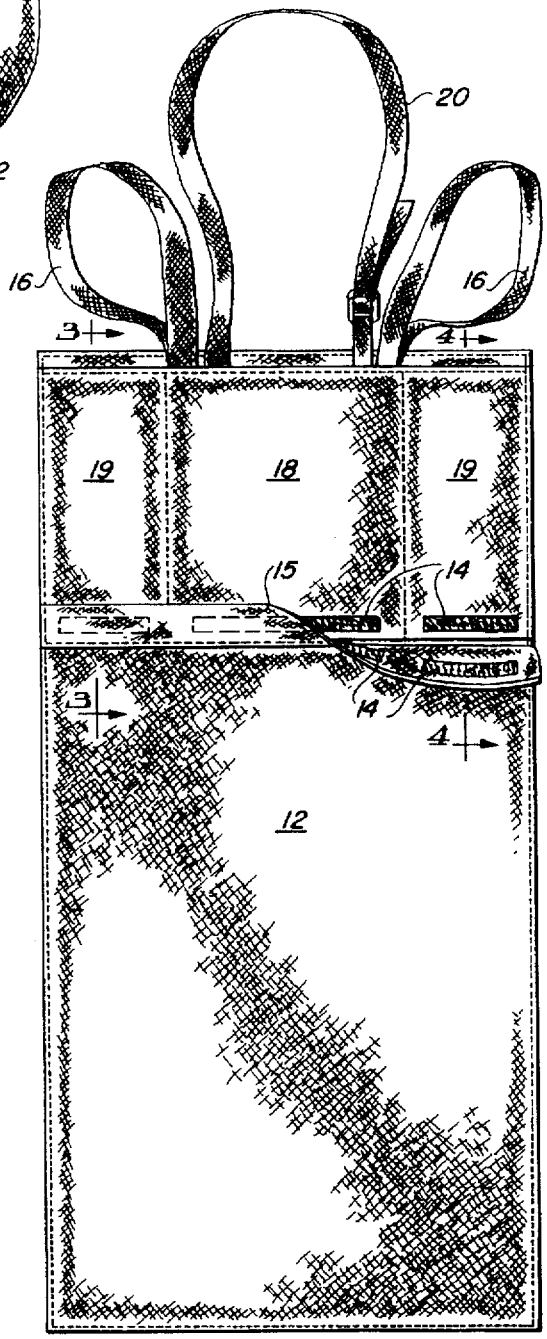
FIG. 2 is a top view of the preferred embodiment of FIG. 1 in an unrolled flat position.

Referring to FIG. 2, there is a top view of a preferred embodiment. In particular, there is a beach blanket (mat or towel) 10 having a main section 12 for laying thereon, a pillow section 18, synthetic strips of material which adhere when pressed together (sold under the trademark VELCRO) 14 for securely holding contents within the pillow section and storage section (not shown in this fig.), a flap 15 extending beyond a strip 14, securing straps 16 located at the top edge of the blanket 10, and carrying strap 20 located adjacent to the securing straps 16.

Figure 1:
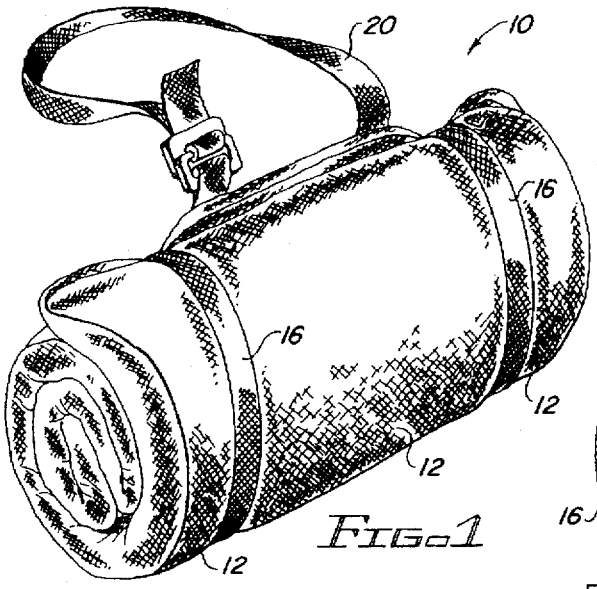
FIG. 1 is a side perspective view of a preferred embodiment.

Referring to FIG. 1, there is a perspective side view of a folded beach blanket 10. As illustrated, the main blanket section 12 has been rolled up and secured by the securing straps 16. The carrying strap 20 extends therefrom and provides an easy means for carrying the beach blanket and associated contents therein.

Figure 3:
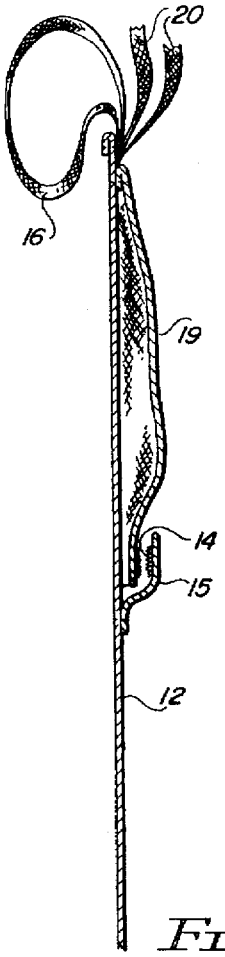
FIG. 3 is a sectional end view of the preferred embodiment of FIG. 1 in an unrolled flat position.
Figure 4:
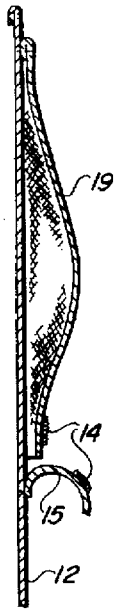
FIG. 4 is a sectional end view along 4—4 of the preferred embodiment of FIG. 1 in an unrolled flat position.

Referring to FIG. 3 & FIG. 4, these are sectional end views of the beach blanket 10. As illustrated, the blanket 10 has a side storage section 19 which is accessible by the VELCRO strip 14 located under flap 15.

Figure 5:
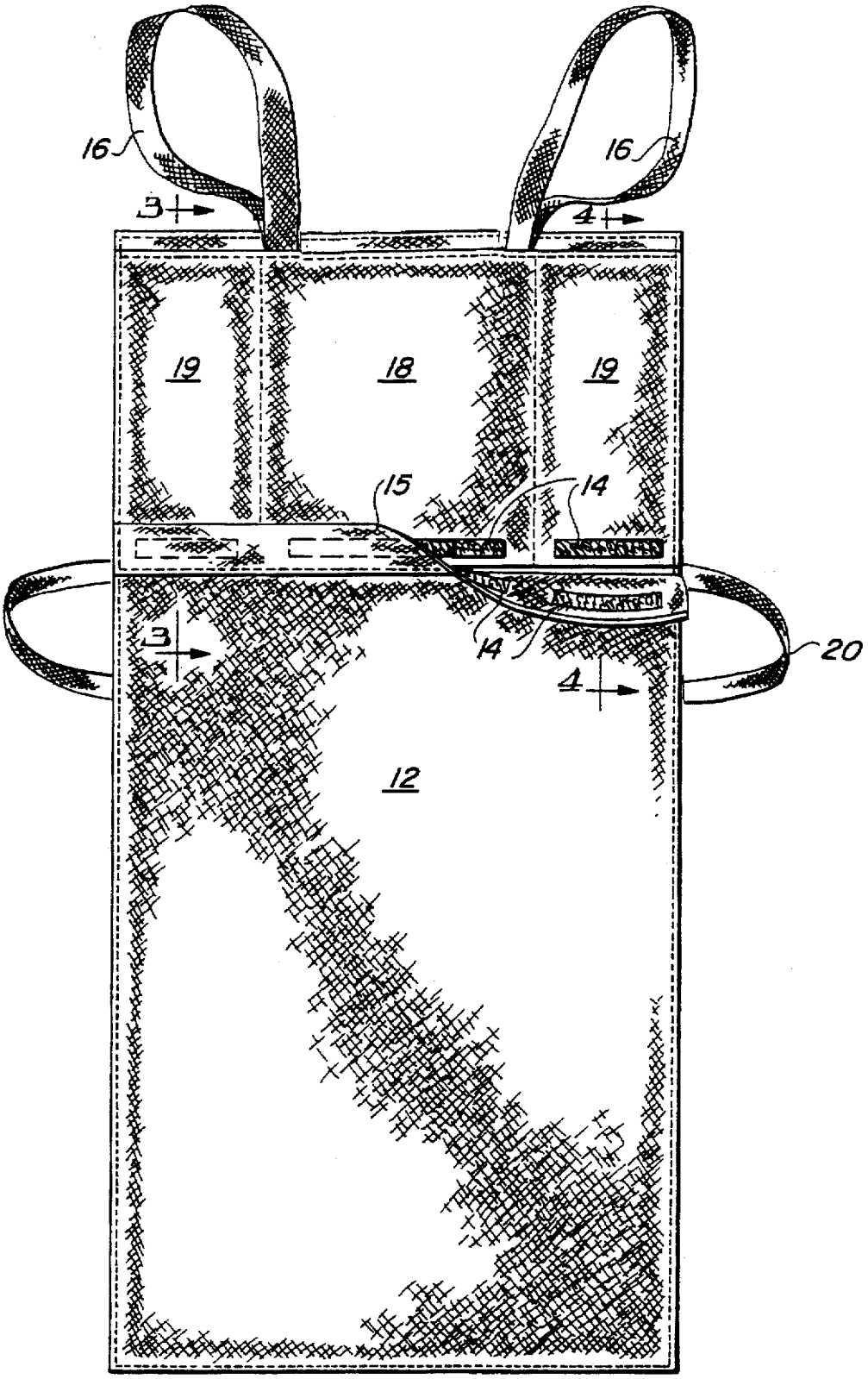
FIG. 5 is a top view illustrating a carrying strap located on the underside of a blanket.

Referring to FIG. 5, there is a top perspective view of another embodiment. Specifically, there is a beach blanket (mat or towel) 10 having a main section 12 for laying thereon, a pillow section 18, a VELCRO strip 14 securely holding contents within the pillow section and storage section (not shown in fig.), a flap 15 extending beyond a strip 14, securing straps 16 located at the top edge of the blanket 10, and carrying strap 20 located on the underside of the blanket 10.

Discussions About the Preferred Embodiment

One skilled in the art of designing beach blankets and the like will note that securing straps 16 are located in a particularly strategic position. By positioning these two straps at the top of the blanket 10 they are out of the way of users while laying out the blanket as in FIG. 2 & FIG. 5. Typical other inventions have securing means located in inconvenient positions, causing people to lay on them or to trip over them.

A skilled artisan will note that the carrying strap 20 is located in a particularly strategic position. When the blanket is laid out as in FIG. 2 strap 20 is located adjacent to the securing straps 16. This design locates the carrying strap 20 in a position that will not be located directly under a place where the users weight is located, such as under the back of the user. Thus, the strap 20 will not cause discomfort to a user when unfolded as in FIG. 2. A skilled artisan will also note that the carrying strap 20 may be located beneath the flap 15 along the base of the pillow 18. Thus, strap 20 will not cause discomfort to the user when the beach blanket is unfolded.

Skilled artisans will notice that the securing straps 16 are located in a particularly strategic position while in a rolled up position, as in FIG. 3. In particular, it is noted that straps 16 are located a short distance from the ends of the main blanket portions 12 so that carrying strap 20 will fit over the securing straps 16 or in another embodiment, between the securing straps 16.

Someone skilled in the art will note that the preferred embodiment is designed with a flap 15 located over VELCRO strips 14. With this design, sand will be further deterred from entering the storage 19 and pillow 18 locations, and sand can more easily be kept away from the VELCRO strip 14.

Skilled artisans will realize that the invention is designed with two container portions 19 for storing items therein.

Variations In The Preferred Embodiment

Although the embodiments only discuss the use of VELCRO to secure the compartments 18 and 19, any type of fastening device will work, like zippers.

The preferred embodiment of the invention discusses the use of three straps 16 and 20. However, one skilled in the art would easily understand how to design many different numbers of straps located in the desired discussed positions.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A combined towel, beach lounging and sleeping pad, and suitcase, comprising:

a) a sheet of toweling material;

b) a continuous piece of toweling material attached to the sheet in a plurality of locations in a manner forming a large storage container at the center of one end of the toweling sheet for receiving and storing soft, bulky material and forming a plurality of additional individual storage containers on said toweling sheet, the additional containers being located toward the edges of the sheet to permit unimpeded use of the toweling sheet for reclining or for drying oneself after swimming;

c) closing means, attached to the towel, for sealing the storage containers;

d) securing means, attached to the ends of the storage containers to extend away from the towel, for securing the towel when in a rolled position for carrying the towel and its contents; and e) carrying means, attached to a back side of the towel parallel to the securing means and located under the securing means when the towel is in a rolled out position, for placing over a shoulder of a user when the towel is in a rolled up position for transporting.

2. The towel of claim 1, wherein the securing means is substantially perpendicular to the carrying means when the towel is in the unrolled position and the rolled position.

3. A beach mat, comprising:

a) an elongated, generally rectangular fabric piece that when flat defines the extent of the mat;

b) pillow means attached to and at one longitudinal extremity of the fabric piece, the pillow being centered substantially on the longitudinal axis of the piece, the pillow having a width extending in both directions from the axis to predetermined distances short of the side extremities of the fabric piece; wherein the pillow means and the fabric piece to gather comprise an integral unit;

c) at least one rectangular fabric overlay, on each side of the pillow and extending from the end of the pillow to the associated side extremity of the fabric piece, each of the fabric overlay being attached to the fabric piece on three sides to define storage pockets;

d) strap means, attached adjacent to the storage pockets to lay out away from the mat, for securely holding the mat in a rolled position;

e) carrying means, attached on a bottom side of the mat and laying along an edge located between the pillow means and the mat when the mat is in an unrolled position, for carrying the mat when in a rolled position so that the carrying means is attached to opposite edges of the mat so as to straddle the strap means; and f) closing means, attached between the mat and storage pockets, for sealing the pockets.

4. The mat of claim 3, wherein the strap means is substantially perpendicular to the carrying means when the mat is in the unrolled position and the rolled position.

* * * * *